US008235377B2

(12) United States Patent
Ambroise et al.

(10) Patent No.: US 8,235,377 B2
(45) Date of Patent: Aug. 7, 2012

(54) MULTI-MODE UNSTACKER DEVICE FOR UNSTACKING MAILPIECES

(75) Inventors: Stephane Ambroise, Tain l'Hermitage (FR); Stephane Samain, Chabeuil (FR); Pierre Chorier-Pichon, Romans (FR)

(73) Assignee: Solystic, Gentilly Cedex (FR)

( * ) Notice: Subject to any disclaimer, the term of this patent is extended or adjusted under 35 U.S.C. 154(b) by 335 days.

(21) Appl. No.: 12/446,057

(22) PCT Filed: Dec. 2, 2008

(86) PCT No.: PCT/FR2008/052182

§ 371 (c)(1),
(2), (4) Date: Apr. 17, 2009

(87) PCT Pub. No.: WO2009/080929

PCT Pub. Date: Jul. 2, 2009

(65) Prior Publication Data

US 2010/0329833 A1 Dec. 30, 2010

(30) Foreign Application Priority Data

Dec. 20, 2007 (FR) ..... 07 60097

(51) Int. Cl.
*B65H 5/00* (2006.01)

(52) U.S. Cl. ..... 271/10.01; 271/11; 271/94; 271/151; 271/153

(58) Field of Classification Search ..... 271/4.01, 271/4.02, 4.03, 5, 10.01, 10.02, 10.03, 11, 271/149, 150, 152, 153, 97, 105, 94
See application file for complete search history.

(56) References Cited

U.S. PATENT DOCUMENTS

| | | | | |
|---|---|---|---|---|
| 5,308,052 | A | 5/1994 | Roch et al. | |
| 6,270,070 | B1 | 8/2001 | Salomon et al. | |
| 2005/0133980 | A1 * | 6/2005 | Koga | 271/97 |
| 2007/0063429 | A1 * | 3/2007 | Kang | 271/264 |
| 2007/0145673 | A1 * | 6/2007 | Chastain et al. | 271/149 |

FOREIGN PATENT DOCUMENTS

| | | | |
|---|---|---|---|
| EP | 0 087 341 | A2 | 8/1983 |
| EP | 0562954 | A1 | 9/1993 |
| EP | 1 602 606 | A2 | 12/2005 |
| FR | 2 797 856 | A1 | 3/2001 |
| FR | 2807347 | A1 | 10/2001 |
| WO | WO 2004/113207 | A1 | 12/2004 |

* cited by examiner

*Primary Examiner* — Michael McCullough
(74) *Attorney, Agent, or Firm* — Rothwell, Figg, Ernst & Manbeck, P.C.

(57) ABSTRACT

A mailpiece unstacker device comprises a feed magazine for moving the mailpieces in a stack and on edge in a certain direction towards an unstacker head. It is provided with materials sensors for delivering signals indicating that a current mailpiece has a cover made of a plastics material and/or includes a metal material. A control unit forces the feed magazine and the unstacker head to operate as a function of the signals generated by the sensors so that the mailpieces are presented facing the unstacker head in positions that are inclined backwards to various extents.

8 Claims, 3 Drawing Sheets

PLASTICS MODE

| Sensor 21 | Sensor 22 | Sensor 23 | Sensor 20 | Belt conveyor 2 | Paddle 4 | Conveyor 12 |
|---|---|---|---|---|---|---|
| X | 0 | 0 | 0 | 1 | 1 | 1 |
| X | 0 | 0 | 1 | 1 | 1 | 0 |
| X | X | 1 | 0 | 0 | 0 | 1 |
| X | X | 1 | 1 | 0 | 0 | 0 |
| X | 1 | 0 | 0 | 0 | 0 | 1 |
| X | 1 | 0 | 1 | 0 | 0 | 0 |

OPEN MODE

| Sensor 21 | Sensor 22 | Sensor 23 | Sensor 20 | Belt conveyor 2 | Paddle 4 | Conveyor 12 |
|---|---|---|---|---|---|---|
| X | X | 0 | 0 | 1 | 1 | 1 |
| X | X | 0 | 1 | 1 | 1 | 0 |
| 0 | X | 1 | 0 | 0 | 0 | 1 |
| 0 | X | 1 | 1 | 0 | 0 | 0 |
| 1 | X | 1 | 0 | 0 | 0 | 1 |
| 1 | X | 1 | 1 | 0 | 0 | 0 |

HETEROGENEOUS MODE

| Sensor 21 | Sensor 22 | Sensor 23 | Sensor 20 | Belt conveyor 2 | Paddle 4 | Conveyor 12 |
|---|---|---|---|---|---|---|
| 0 | X | 0 | 0 | 1 | 1 | 1 |
| 0 | X | 0 | 1 | 1 | 1 | 0 |
| X | X | 1 | 0 | 0 | 0 | 1 |
| X | X | 1 | 1 | 0 | 0 | 0 |
| 1 | X | 0 | 0 | 0 | 0 | 1 |
| 1 | X | 0 | 1 | 0 | 0 | 0 |

MULTI-MODE UNSTACKER DEVICE FOR UNSTACKING MAILPIECES

CROSS-REFERENCE TO RELATED APPLICATIONS

This application is a 35 U.S.C. 371 National Phase Application from PCT/FR2008/052182, filed Dec. 2, 2008, and designating the United States, which claims the benefit of France Patent Application No. 0760097, filed Dec. 20, 2007.

BACKGROUND OF THE INVENTION

1. Field of the Invention

The invention relates to an unstacker device for unstacking mailpieces, which unstacker device comprises a motor-driven feed magazine for moving the mailpieces in a stack and on edge in a certain direction towards an unstacker head suitable for separating a first mailpiece from the stack and for driving it in a direction that is transverse to said direction in which the stack of mailpieces move.

The invention relates more particularly to a mailpiece unstacker device for a machine for sorting large-format mailpieces or "flats". A mailpiece can, in particular, be a letter in an envelope with or without a window, a magazine, a newspaper, or a catalogue in a plastics or paper cover.

2. Discussion of the Background Art

In general, in a postal sorting machine, the mailpieces exiting from the unstacker are conveyed in series and on edge so as to be brought past a read head. The read head acquires an image of each mailpiece in the series for the purpose of automatically decoding the inward sorting address or the outward sorting address of the mailpiece by Optical Character Recognition (OCR) processing. The mailpieces are then directed towards the sorting outlets corresponding to the automatically decoded addresses.

FIG. 1 shows a mailpiece unstacker device known from Patent Document FR 2 797 856 and that comprises a belt main magazine 1. The main magazine 1 comprises in particular a belt conveyor 2 that is motor driven for the purpose of moving the mailpieces in the direction indicated by arrow 6. An operator places the mailpieces 3 in a stack on edge on the belt conveyor 2 in front of a paddle 4. The paddle 4 extends in a substantially vertical plane and is disposed facing an unstacker head or plate 5. The paddle 4 is also motor-driven so as to push the back of the stack and so as to move it in the direction indicated by the arrow 6 towards the unstacker head 5.

The mailpieces forming the stack are held laterally by a jogging edge 7 that extends in a substantially vertical plane along a side edge of the belt conveyor 2. The substantially plane unstacker head 5 extends in a vertical plane that is transverse to the direction indicated by the arrow 6 and in which the stack of mailpieces 3 move on the belt conveyor 2, and is suitable for separating the first mailpiece at the front of the stack in the transverse direction indicated by the arrow 8 that is perpendicular to the arrow 6.

The unstacker head 5 is provided with two substantially rectangular openings in each of which a perforated belt 9 and one or more suction chambers or suction nozzles (not shown) are motor-driven. The perforated belt 9 and the suction nozzles co-operate to take hold of the first mailpiece of the stack by suction and to move it in the direction indicated by the arrow 8.

In operation, the stack of mailpieces 3 placed in the main magazine 1 is moved by the stepper-type motor drive means for driving the belt conveyor 2 and the paddle 4 that are actuated at the same speed. The first mailpiece at the front of the stack of mailpieces is thus brought into abutment against the unstacker head 5 so that that current mailpiece of the stack is pressed against the unstacker head 5 and is separated from the stack by the combined effect of the suction of the nozzles and of the movement of the perforated belt 9. The mailpiece is then nipped between two deformable wheels 10 disposed in alignment with the head 5, i.e. downstream from the unstacker head in the direction indicated by the arrow 8. Said wheels 10 are motor-driven so as to convey the current mailpiece downstream from the unstacker device. They are made of an elastically deformable elastomer material so that they can adapt to accommodate various mailpiece thicknesses.

The unstacking process is repeated each time a new mailpiece at the front of the stack is presented facing the unstacker head 5.

For the remainder of the sorting process, it is necessary for the mailpieces to be put in series at the outlet of the unstacker device with a constant pitch between consecutive mailpieces. Driving of the perforated belt 9 and of the suction nozzles is thus actuated and stopped at a constant rate. For example the rate is 3 mailpieces per second.

In that known device, the mailpieces of the stack are put in series continuously at a constant unstacking rate. It has been observed that a large proportion of mailpieces are not presented appropriately facing the unstacker head at the time at which they are unstacked, and, as a result, those mailpieces might be damaged or torn, e.g. when they are taken by the wheels 10, for example. It can even happen that those mailpieces cause a jam in the unstacker device, requiring action from a maintenance operator, and requiring the unstacker device to be stopped. Such action is costly and slows down the overall sorting process. That situation can be particularly frequent with mailpieces of the following types that are open: advertising brochures, magazines, etc. In addition, that type of device does not completely eliminate situations in which mailpieces are taken in bunches. The fact that the range of large-format mailpieces or "flats" to be processed can be relatively wide makes those problems even more complex to solve.

European Patent Document EP 0 562 954 describes a feed device similar to the device presented above and that further comprises a motor-driven drop-forming channel disposed between the belt conveyor and the unstacker head. The effect of that motor-driven drop-forming channel is to fan out the mailpieces as they are presented. Thus, the first mailpieces at the front of the stack find themselves less tightly stacked against the other mailpieces. In addition, presence sensors are disposed so as to monitor the inclinations of the fanned-out mailpieces, and a control unit controls operation of the motor-driven drop-forming channel and of the belt conveyor so as to fill the drop-forming channel and so as to incline the mailpieces. That above-described arrangement is suitable for certain categories of mailpiece but does not cover a broad range of mailpieces to be processed.

Unfortunately, what is suitable for one mailpiece is not necessarily optimum for another mailpiece. For example, flats slip down under their weight, magazines open and tear, etc.

SUMMARY OF THE INVENTION

An object of the present invention is thus to improve the performance of the unstacker device for a broader range of flat articles. In particular, objects of the invention are to prevent such flat articles from being damaged, to prevent the unstacker from jamming, to increase the processing rate, and to reduce the rate of mailpiece bunching.

To these ends, the invention provides a mailpiece unstacker device as defined above, characterized in that it further comprises at least one material sensor suitable for delivering a signal indicating the presence of at least a certain material in a current mailpiece, and a control unit for causing said feed magazine and said unstacker head to operate in a plurality of operating modes specific to the presence or to the absence of said material(s) in the mailpieces to be unstacked, said control unit being arranged to choose an operating mode from among said plurality of operating modes as a function of the signal delivered by said sensor. The presence of one or more materials sensors makes it possible to categorize each mailpiece, in particular so as to determine whether it is a mailpiece that is in a cover made of a plastics material, a mailpiece that is open, or a mailpiece that is non-open, so as to parameterize precisely operation of the feed magazine and of the unstacker head.

More particularly, the unstacker device of the invention further comprises:

- a first sensor suitable for delivering a first signal indicating that a separated current mailpiece of the stack has a cover made of a plastics material, e.g. a gloss sensor or a sensor such as the sensor described in Patent Application FR 2 807 347;
- a second sensor suitable for delivering a second signal indicating that the separated current mailpiece includes a metal material, e.g. an inductive sensor; and
- a control unit that responds to the two signals by determining an operating mode from among at least three operating modes for causing the feed magazine and the unstacker head to operate, said three operating modes comprising: a) a first operating mode referred to as the "plastics" mode and in which the control unit forces the feed magazine and the unstacker head to operate so that a certain number of mailpieces facing the unstacker head are presented while being inclined backwards by about 15° relative to the unstacker head; b) a second operating mode referred to as the "open mode" and in which the control unit forces the feed magazine and the unstacker head to operate so that a certain number of mailpieces facing the unstacker head are presented while being substantially upright parallel to the unstacker head; and c) a third operating mode referred to as the "heterogeneous mode" and in which the control unit forces the feed magazine and the unstacker head to operate so that a certain number of mailpieces facing the unstacker head are presented in an intermediate position that is situated between the inclined position of the first operating mode and the upright position of the second operating mode.

In a particular embodiment, the unstacker device of the invention further comprises at least one blower member disposed so as to blow a jet of air onto said mailpieces facing the unstacker head. The control unit has at least three sets of control parameters for causing the blower member to operate in one of the first, second, or third operating modes.

In particular, the blower member comprises: a first blower element disposed between the feed magazine and the unstacker head in such a manner as to blow a stream of air that is substantially vertical and that is directed upwards; a second blower element disposed downstream from said unstacker head relative to said transverse direction in such a manner as to blow a stream of air that is substantially vertical and that is directed upwards; and a third blower element disposed downstream from the unstacker head relative to said transverse direction in such a manner as to blow a stream of air that is substantially horizontal and that is directed in the opposite direction to the transverse direction.

In another particular embodiment of the device of the invention, the unstacker head has a perforated belt that is motor-driven at variable speed controlled by the control unit, and the control unit has at least three sets of speed profile for causing the motor-drive means of the unstacker head to operate in one of said first, second, or third operating modes.

The unstacker device of the invention is more particularly applicable to machines for sorting large-format mailpieces or "flats", but it can also be used for small-format mailpieces.

BRIEF DESCRIPTION OF THE DRAWINGS

The invention can be better understood on reading the following description given with reference to the drawings. This description is given by way of indication and is in no way limiting to the invention. In the drawings.

DETAILED DESCRIPTION OF THE PREFERRED EMBODIMENTS

Figure 1:
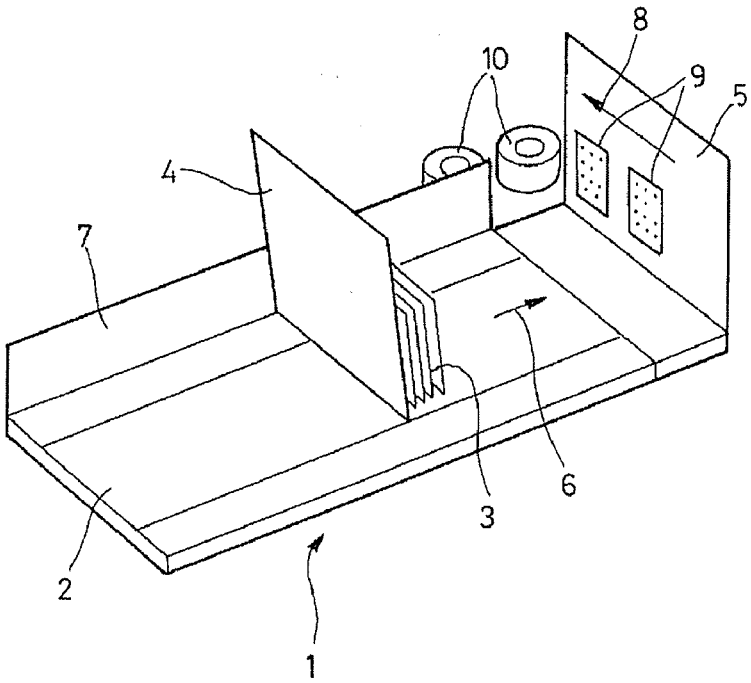
FIG 1 (PRIOR ART)
FIG. 1 is a diagrammatic perspective view of a feed device for a state-of-the-art flat-mailpiece unstacker.

FIG. 1 is described above with reference to a state-of-the-art flat-mailpiece unstacker.

Figure 2:
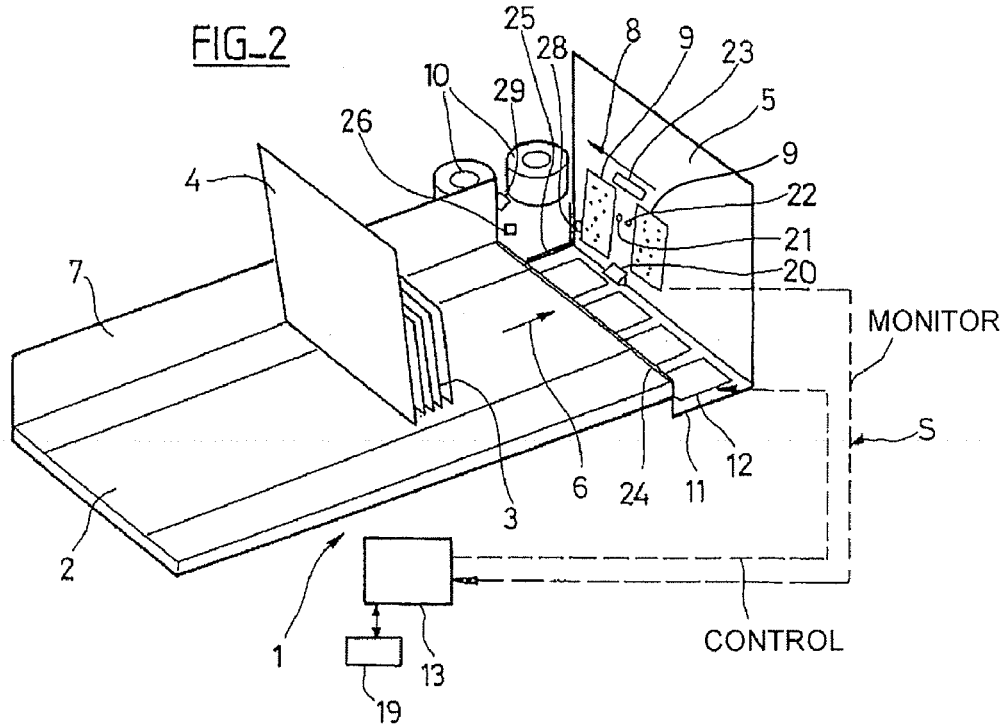
FIG. 2 is a diagrammatic perspective view of a mailpiece unstacker device of the invention.

FIG. 2 shows a mailpiece unstacker device of the invention for unstacking mailpieces such as letters and flats (i.e. large-format flat mailpieces) that may optionally have plastics covers. The elements in common with FIG. 1 bear identical numerical references.

This unstacker device puts the mailpieces in series one-by-one prior to them being conveyed, during which they are moved with a normally constant pitch.

The motor-drive means for driving the deformable wheels 10 between which the mailpieces in series are nipped can be caused to operate at a variable speed so as to take up any differences in pitch between consecutive mailpieces, if necessary. This variable-speed arrangement constitutes a synchronization system guaranteeing constant pitch.

Advantageously, this synchronization system enables certain correction operations to be performed, during a time window T that is compatible with the requirement of having constant pitch between consecutive mailpieces at the outlet of the unstacker device.

The unstacker device comprises a main feed magazine 1 provided with a belt conveyor 2 that is motor-driven and on which mailpieces 3 are placed in a stack and on edge in front of a paddle 4 that is motor-driven and that extends substantially in a vertical plane while being slightly inclined so as to support the back of the stack of mailpieces.

The belt conveyor 2 and the paddle 4 move the stack of mailpieces 3 on edge towards the unstacker head 5 in the direction 6.

A jogging edge 7 against which the side edges of the mailpieces are aligned is also shown along the belt conveyor 2.

FIG. 2 shows a trough-shaped drop-forming channel 11 constituting a secondary feed magazine between the end of the main conveyor 2 and the unstacker head 5. The bottom of the drop-forming channel 11 is situated at a depth of about 79 millimeters (mm) below the top surface of the conveyor 2 and has a width of about 98 mm in the direction 6.

The bottom of said drop-forming channel 11 is provided with a set of secondary conveyors 12 that are motor-driven, e.g., as in this example, four belt conveyors that move the mailpieces on edge in the drop-forming channel in the direction 6 towards the unstacker head 5.

The motor-driven unstacker head 5 extends vertically from the bottom of the drop-forming channel 11 to a sufficient height that corresponds at least to the maximum height of the mailpieces to be unstacked.

The unstacker head 5, in the form of a metal sheet, is, in this example, provided with two openings of rectangular shape that are disposed side-by-side in the direction 8. In each of said openings, an endless perforated belt 9 is co-operates with suction chambers or suction nozzles (not shown) for taking hold of a current mailpiece from the stack facing the unstacker head and for moving said mailpiece in the direction 8.

The unstacker device of the invention also comprises three blowers operated by solenoid valves. As explained in detail below, the blowers control the spacing-out of the stack, i.e. the forced spaces between the successive mailpieces in the stack.

A first blower 24 that is elongate in shape, such as a longitudinal slot, is disposed at the transition zone between the main conveyor 2 and the drop-forming channel 11, and constitutes a side edge of the conveyor 2.

A second blower 25 that is also elongate in shape, such as a longitudinal slot, is disposed at the transition zone between the drop-forming channel 11 and the deformable wheels 10, and constitutes a side edge of the drop-forming channel 11.

The first and second blowers 24 and 25 are arranged to exert a substantially vertical blowing pressure that is directed upwards.

A third blower 26 is disposed at the transition zone between the drop-forming channel 11 and the deformable wheels 10 in offset manner so as not to obstruct the mailpieces as they pass between the deformable wheels 10. Said third blower 26 is disposed at a height of about 60 mm and exerts a substantially horizontal blow pressure that is directed slantwise in the direction opposite to the direction indicated by the arrow 8.

Figure 3:
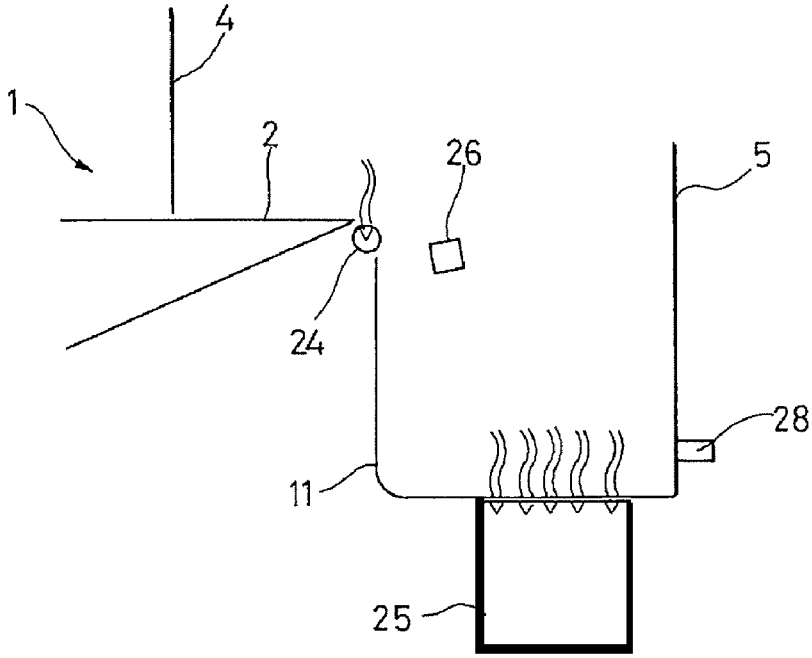
FIG. 3 is a diagrammatic side view of the mailpiece unstacker device of FIG. 2.
Figure 4:
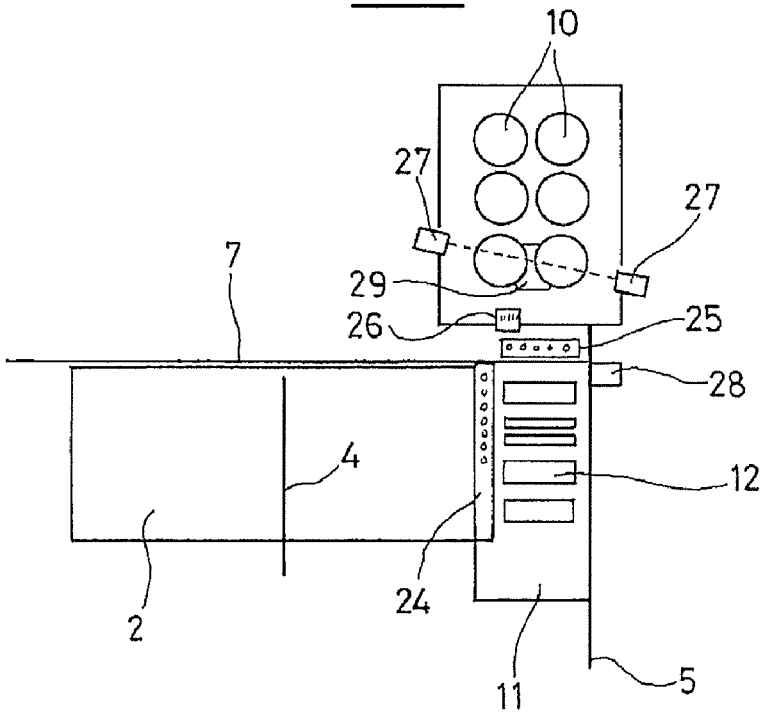
FIG. 4 is a diagrammatic plan view of the mailpiece unstacker device of FIG. 2.

The first, second, and third blowers 24, 25, and 26 are also shown in a side view and in a plan view in FIGS. 3 and 4.

In the description below, the term "actuator" is used to encompass: the belt conveyor 2; the paddle 4: the secondary conveyors 12 of the drop-forming channel 11; the perforated belt and the suction nozzles of the unstacker head 5; and the first, second, and third blowers 24, 25, and 26.

The motor-drive means for driving each of said actuators is connected to a control unit 13, e.g. a programmable data-processing processor. In FIG. 2, for reasons of clarity, a single control link CONTROL is shown between the control unit 13 and a second conveyor 12, but naturally the unit 13 is also connected via control links to the motor-drive means of the other actuators.

The control unit 13 is arranged to control the motor-drive means independently, i.e. asynchronously. It is understood that said motor-drive means can be synchronized with one other via the control unit 13. In addition, the control unit is arranged to change the speeds, the accelerations, and the directions of the motor-drive means of the feed magazine and of the actuators in general.

In addition, the unstacker device of the invention further comprises a set of sensors, each of which delivers a detection signal to the control unit 13. As above, for reasons of clarity, a single monitoring link MONITOR is shown between the control unit 13 and a sensor, but naturally the unit 13 is also connected via monitoring links to the other sensors used in the invention as described below.

More particularly, FIG. 2 shows four presence sensors 20 to 23 disposed in the unstacker head 5 between the two openings in the head in which the perforated belts 9 act.

The sensor 20 that is disposed lowermost on the unstacker head 5, at the bottom of the drop-forming channel 11 is, in this example, a flag mechanical sensor in the form of a finger that is retractable into the thickness of the head 5 so as to detect the presence of a mailpiece facing the lowermost portion (the bottom) of the head 5.

The sensor 20 delivers a signal indicating the presence of a mailpiece when it is retracted sufficiently into the head under the effect of the thrust from the foot of the current mailpiece in the direction 6, which mailpiece is itself pressed by the stack of mailpieces bearing against one another in the drop-forming channel 11. More particularly, in the rest position, said sensor 20 has a free end that projects relative to the unstacker head and that has a bevel profile flaring in the direction 6 and whose flat portion is flush with the bottom of the drop-forming channel 11. The sensor 20 moves in the direction 6 in opposition to a return spring (not shown), and the signal that it delivers, when it is retracted into the unstacker head 5, can also indicate the distance over which it is retracted relative to its rest position, and thus a magnitude of pressure exerted by the stack. FIG. 2 shows that it is disposed below the bottom line of the perforated belts 9.

The sensor 20 is adapted to measure the pressure exerted by all of the mailpieces in the drop-forming channel at the feet of the mailpieces. A pressure of 0.3 newtons (N) from the feet of the mailpieces against the unstacker head places the mailpieces of the drop-forming channel in a situation adapted to unstacking. Provision can be made to monitor the pressure from the feet of the mailpieces, and said pressure can be adjusted by feeding the drop-forming channel 11 with mailpieces.

The sensors 21 and 22 are reflection photoelectric cells that are disposed vertically above the sensor 20, e.g. at 80 mm from the bottom of the drop-forming channel, for the purpose of detecting the presence of a current mailpiece facing an intermediate first portion of the head above the bottom portion of the head.

The sensors 21 and 22 are set so that each of them delivers a signal indicating the presence of a mailpiece when said mailpiece is respectively 6 mm and 13 mm from the head 5 in the direction 6.

The sensor 23 is disposed vertically above the perforated belts 9. Said sensor 23 is a flag mechanical sensor in the form a finger that is retractable into the thickness of the head 5 for the purpose of detecting the presence of a mailpiece facing the top portion of the head 5. For example, the sensor 23 is in the shape of a prism forming a trapezoid in section. In the rest position, the sensor 23 projects relative to the unstacker head.

By moving in the direction 6, the sensor 23 delivers a signal indicating the presence of a mailpiece when it is retracted sufficiently into the head under the effect of the thrust from the top of the current mailpiece. The signal transmitted by the sensor 23 also indicates the pressure exerted by the top of the stack of mailpieces. The pressure exerted on said sensor can be adjusted by feeding the drop-forming channel with mailpieces or by activating certain actuators so as to straighten up the stack of mailpieces.

FIG. 4 shows the barrier photoelectric sensor 27 that is disposed vertically at a height of about 80 mm from the bottom of the drop-forming channel and that has its beam directed transversely to the unstacking direction indicated by the arrow 8. In addition, the barrier sensor 27 is situated in the inlet cone in the vicinity of and upstream from the deformable wheels 10 for the purpose of detecting the presence of mailpieces engaged in the system of deformable wheels.

Advantageously, the unstacker device of the invention is also provided with materials sensors, including a plastics material sensor 28 as shown in FIGS. 2, 3, and 4. For example, the sensor 28 is disposed in the unstacker head 5 downstream from the perforated belt in the direction indicated by the arrow 8 and in the bottom portion of the perforated belt, so as to detect the presence of plastics material only for the current mailpiece to be unstacked.

In this embodiment, the plastics material sensor 28 is a gloss sensor composed of one or more emitter photocells that are calibrated in the infrared range and that sweep the surface of the mailpiece with infrared radiation, and one or more calibrated receiver photocells that measure the intensity reflected at all points of the surface of the mailpiece. Experiment shows that the use of infrared radiation for measuring gloss procures satisfactory results for detecting surfaces made of plastics material. The emitted and received intensities are compared by the control unit 13 so as to distinguish between mailpieces having surfaces made of plastics material or wrapped in a cover made of plastics material.

It is easy to incorporate such a sensor into a postal sorting machine because such a sensor has low cost and small size, indeed its size is less than one cubic decimeter.

The unstacker device of the invention is also provided with an inductive sensor 29 for detecting metal materials. Said inductive sensor 29 is disposed in the bottom portion between two rows of deformable wheels 10, as shown in FIG. 4. With this arrangement, the mailpieces that are unstacked and moved between the deformable wheels pass one-by-one above the inductive sensor 29. Advantageously, this configuration makes it possible to detect metal materials contained in mailpiece without having any unwanted influence on the other mailpieces.

Such an inductive sensor 29 makes it possible to detect the presence of staples on the edges of mailpieces, which is specific to open mailpieces of the magazine type.

The relationship between the various sensors and the various actuators is specified below for various categories of mailpieces.

In accordance with the invention, the plastics material sensor 28, and the inductive sensor 29 indicate the presence of plastics material or metal material on the mailpiece, and define respectively mailpieces of the category having plastics covers and mailpieces of the category that are open, such as a magazine, for example.

These two categories of mailpiece are processed in different manners in the unstacker device of the invention. They lead to three distinct modes of operation: the plastics mode, the open mode, and the heterogeneous mode, for which the mailpieces to be processed belong to the plastics and to the open categories.

In general, in an open mode, it is considered that a certain number of following mailpieces to be unstacked present an open configuration, i.e. that the mailpiece can be open like a magazine. In the description below, such a mailpiece is referred to as an "open mailpiece". In which case, the unit 13 causes the actuators to operate in such a manner as to obtain a stack of mailpieces that are upright, vertical, and tightly pressed against the unstacker plate 5. This configuration of the stack of open mailpieces prevents the first page of the current mailpiece from being sucked by the suction nozzles and unstacked by the perforated belt while the following pages of the same mailpiece remain set back in the drop-forming channel, thereby damaging the mailpiece and doubtless jamming the machine.

Conversely, in a plastics mode, it is considered that a certain number of following mailpieces to be unstacked have covers made of plastics materials. They are referred to below as "plastics mailpieces". In which case, the unit 13 controls the actuators in such a manner as to obtain a stack of mailpieces inclined backwards by about 15° relative to the vertical, i.e. in the direction opposite from the direction indicated by the arrow 6. Mailpieces provided with plastics covers have high coefficients of friction because of the electrostatic phenomenon related to the plastics material that tends to cause the mailpieces to stick together when they are in a stack. Similarly, the plastics seal or "weld" that is designed to close the plastics cover tends to increase the phenomenon of adhesion between the mailpieces in the stack. As a result, the inclined configuration of the stack of mailpieces makes it possible to prevent a plurality of plastics mailpieces from being unstacked at the same time. In accordance with the invention, the frequency of bunching is reduced significantly.

Figures 5, 6:
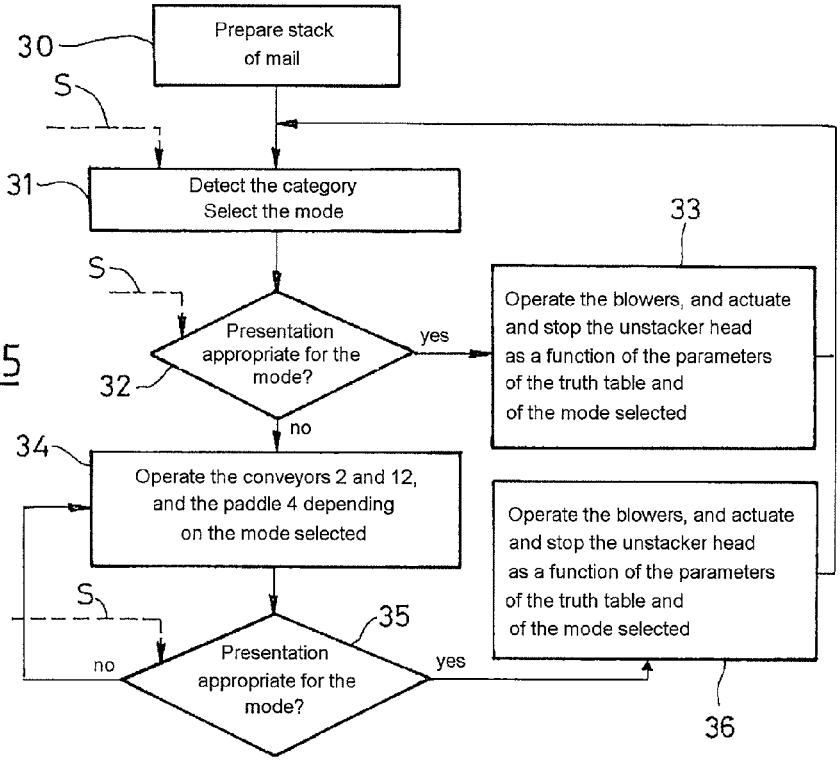
FIG. 5 is a flow chart of the unstacking method of the invention.
FIG. 6 shows the commands for controlling the actuators in the form of tables.

FIG. 5 is a flow chart showing the method of the invention that uses the above-described unstacker device as a function of the various categories of mailpiece.

In the preparation step 30, mailpieces are firstly placed by the operator in a stack and on edge on the main conveyor 2 in front of the paddle 4. The control unit 13 actuates the motor-drive means of the actuators for operation at a constant unstacking rate. The speeds of movement of the belt of the conveyor 2 and of the paddle 4 are identical. The speed of movement of the belts of the conveyors 12 is slightly greater than the speed of movement of the belt 2 or of the paddle 4. The speed of movement of the belts 9 is much greater than the speed of movement of the belts of the conveyors 12. By way of example, in the normal unstacking mode, the speed of the belt 2 is 0.096 meters per second (m/s), the speed of the belts of the conveyors 12 is 0.152 m/s, and the speed of the perforated belts 9 is 1.5 m/s.

The stack of mailpieces 3 on edge thus advances towards the unstacker head 5 and first mailpieces at the front of the stack fall into the drop-forming channel 11. In this example, the stack of mailpieces is thus split and the mailpieces on edge in the drop-forming channel fan out under the action of the faster movement of the conveyors 12 in the bottom of the drop-forming channel. A first current mailpiece to be unstacked is detected, for example, by the sensors 20, 21, and 23.

The process continues in step 31, in which signals S are transmitted by the gloss sensor 28 while the current mailpiece is being unstacked, and then by the inductive sensor 29 when the barrier sensor 27 is masked. It can be understood that the configuration of the sensors 28 and 29 makes it possible to transmit signals S that concern a single mailpiece only. These signals are combined to determine the category of the current mailpiece and the appropriate unstacking mode.

In accordance with the invention, the following combination is applied: if the two sensors indicate respectively the presence of plastics material and the presence of metal material, it is considered that the mailpiece is an open magazine wrapped in a plastics cover and that, therefore, it belongs to the plastics mailpiece category. This is because its open configuration no longer has any effect if said mailpiece is wrapped. If the sensor 28 indicates that the current mailpiece is a plastics mailpiece and if the sensor 29 does not indicate that it is an open mailpiece, then it is considered that the current mailpiece is a plastics mailpiece. If, however, the sensor 28 indicates that the current mailpieces is not a plastics mailpiece and the sensor 29 indicates that it is an open mailpiece, then it is considered that the current mailpiece is an open mailpiece. Finally, if the sensors 28 and 29 indicate that the current mailpiece is neither a plastics mailpiece nor an open mailpiece, then the mailpiece is of the type referred to as "other".

In addition, in step 31 for detecting the category of mailpiece, the category of each current mailpiece is stored in a memory 19 connected to the control unit 13. The control unit 13 then automatically determines the category of the following mailpieces to be unstacked by counting the number of mailpieces recorded in the memory that belong to a particular category.

For example, if, of the last 200 mailpieces unstacked, at least 80% belong to the plastics category, then the unstacking mode for the following mailpieces to be unstacked is the plastics mode. Conversely, if, of the last 200 mailpieces unstacked, at least 80% belong to the open mailpiece category then the unstacking mode for the following mailpieces to be unstacked is the open mode. Finally, if neither of the preceding conditions is satisfied, i.e. if neither the open mailpiece category nor the plastics mailpiece category cover 80% of the last 200 mailpieces unstacked, then the selected unstacking mode is said to be "heterogeneous mode". It can be understood that, in the absence of indications about the category of the mailpieces, said mailpieces are unstacked in a heterogeneous mode that is also referred to as "normal mode".

The unstacking mode is thus updated in real time by storing the counts of the categories for each unstacked mailpiece in a memory. Such a mailpiece unstacker device can be said to be "multi-mode".

At this stage, the process continues at step 32 when the signals S delivered by the sensors 20, 21, 22, and 23 are monitored by the control unit 13 in order to determine whether the mailpiece to be unstacked is presented appropriately for the unstacking mode determined at step 31 in order for it to be unstacked without any risk of damage or of jamming.

If, at step 32, the signals S of the sensors 20, 21, 22, and 23 indicate that the current mailpiece is presented appropriately as a function of the unstacking mode, and if the current time lies within the time window T compatible with constant pitch, then, in step 33, the control unit 13 controls the various actuators as a function of the mode selected in step 31. Each appropriate presentation is described in detail below with reference to the tables shown in FIG. 6 depending on the unstacking mode.

The presentation of the current mode is considered to be appropriate in the plastics mode if the sensors 20 and 22 are masked and if the sensors 21 and 23 are not masked, thereby indicating that the stack of mailpieces is inclined backwards at about 15°. For the open mode, the presentation of the current mailpiece is considered to be appropriate if the sensors 20 and 23 are masked, thereby indicating that the mailpiece is upright. Finally, in the heterogeneous mode, the presentation of the current mailpiece is considered to be appropriate if the sensors 20 and 21 are masked, thereby indicating that the stack of mailpieces is inclined backwards slightly in an intermediate position between the position of the plastics mode and the position of the open mode. When the sensors indicate that the current mailpiece is in an appropriate position in step 32, the belt conveyor 2, the paddle 4, and the secondary conveyors 12 are not actuated in step 33, and the mailpiece is unstacked by means of the perforated belts 9.

In the plastics mode, in step 33, the unit 13 causes, for example, the first blower 24 to exert a pressure of about 1 bar, the second blower 25 to exert a pressure of 1.8 bars, and the third blower 26 to exert a pressure of 0.9 bars. In addition, with the desired speed of the perforated belts 9 being 1.5 m/s, in said plastics mode, in step 33, the unit 13 controls the motor-drive means of said perforated belts so that said desired speed is reached, for example, in 130 milliseconds.

The first and second blowers 24 and 25 exert a pressure designed to separate the plastics mailpieces that tend to stick together. For the same reason, the unstacking speed of 1.5 m/s must be reached rapidly. This high acceleration makes it possible to extract the current mailpiece from the stack. It is understood that the risk of damage is low because of the strength of the plastics cover, in spite of the high acceleration.

In the heterogeneous mode, in step 33, the unit 13 causes the first blower 24 and the second blower 25 to be closed, the third blower 26 exerting a pressure of 0.9 bars. The unit 13 also controls the motor-drive means of the perforated belts so that the speed of 1.5 m/s is reached, for example, in 179 milliseconds.

In the open mode, at step 33, the unit 13 causes the first blower 24 and the second blower 25 to close, the third blower 26 exerting a pressure of 0.3 bars. The unit 13 also controls the motor-drive means of the perforated belts so that the speed of 1.5 m/s is reached, for example, in 216 milliseconds. Since open mailpieces stick together with relatively low adhesion, the pressure exerted by the first and second blowers 24 and 25 is no longer necessary. However, open mailpieces need to be unstacked with relatively low acceleration so as not to be damaged.

The process then loops back to step 31 in order to determine the category to which the following mailpiece belongs. The category of the following mailpiece is stored in the memory 19 and access to said memory 19 makes it possible to select the appropriate mode as described above.

If, at step 32, the signals S of the sensors 20, 21, 22, and 23 indicate that the current mailpiece is presented inappropriately as a function of the unstacking mode, the process continues at step 34 in which the unit 13 controls the actuators depending on the states of sensors and on the mode selected in step 31.

FIG. 6 shows the various commands for controlling the belt conveyor 2, the paddle 4, and the secondary conveyors 12, in accordance with three tables corresponding to respective ones of the three modes. In said tables, the value "0" corresponds to a sensor that is not masked or to an actuator that is not operating, and the value "1" corresponds to a sensor that is masked or to an actuator that is operating. The value "X" corresponds to an non-defined value, i.e. "1" or "0".

In general, if the sensor 20 is masked or pressed because it is a mechanical sensor, then the secondary conveyors are not caused to operate or to be driven, and they are at a standstill. The sensor 20 being in a masked state indicates that the foot of the stack of mailpieces is pressed against the unstacking plate. It is therefore not necessary to cause the secondary conveyors 12 to operate.

However, if the sensor 20 is masked, then the secondary conveyors 12 are caused to be driven at a speed of 0.152 m/s, for example. This causes the foot of the stack of mailpieces to advance so as to press it against the unstacking plate.

In addition, the tables of FIG. 6 show that, in the plastics mode, the belt conveyor 2 and the paddles 4 are controlled by the states of the sensors 22 and 23 which are combined using the OR logic function. For example, if the sensor 22 is in a masked state "1", then the belt conveyor 2 and the paddle 4 are not operating. They are at a standstill, as indicated by the value "0". This example corresponds to rows 6 and 7 of the plastics mode in FIG. 6. It can be understood that, in this situation, the mailpieces constituting the stack are not inclined backwards to a sufficient extent. It is therefore necessary to reduce the stack by unstacking in order to obtain the appropriate inclination. In the example corresponding to the third row, the sensors 22 and 23 are not masked, and the stack is thus over-inclined. In which case, the unit 13 causes the belt conveyor 2 and the paddle to operate, e.g. at a speed of 0.096 m/s.

In the open mode, the belt conveyor 2 and the paddle 4 are controlled by the states of the sensors 21 and 23 that are combined using the AND logic function. For example, if the sensors 21 and 23 are in a masked state "1", then the belt conveyor 2 and the paddle 4 are not caused to operate. They are at a standstill, as indicated by the value "0". This example corresponds to the rows 6 and 7 of the open mode in FIG. 6. It can be understood that, in this situation, the stack of mailpieces is upright and pressed against the unstacking plate in order to prevent the mailpieces from being damaged.

In the heterogeneous mode, the belt conveyor 2 and the paddle 4 are controlled by the states of the sensors 21 and 23 that are combined using the OR logic function. For example, if the sensor 23 is in a masked state "1", then the belt conveyor 2 and the paddle 4 are not caused to operate. They are at a standstill, as indicated by the value "0". This example corresponds to the rows 6 and 7 of the open mode in FIG. 6. It can be understood that, in this situation, the stack of mailpieces is inclined sufficiently for unstacking without any risk of damaging or jamming.

In step 35, the unit 13 monitors the signals S delivered by the sensors to the control unit 13 to determine whether the current mailpiece is now presented appropriately as a function of the selected mode. In practice, the steps 34 and 35 can be performed almost simultaneously.

If, in step 35, the signals S of the sensors indicate that the current mailpiece to be unstacked is presented appropriately, and that the current time lies within the time window T compatible with constant pitch between consecutive mailpieces at the outlet of the unstacker device, then the control unit 13 continues the process at step 36 by operating the blowers and by actuating the perforated belts 9 and the suction nozzles. The process then loops back to step 31 for determining the category of the following mailpiece. The category of the following mailpiece is stored in the memory 19 and access to said memory 19 makes it possible to select the appropriate mode as described above.

In step 35, if the signals S of the sensors indicate that the current mailpiece to be unstacked is not presented appropriately and that the selected mode is the open mode or the heterogeneous mode, then the process loops back to step 34. In accordance with the invention, it is considered that the risk of an improperly presented open mailpiece being damaged is too high to allow said mailpiece to be unstacked. When a plastics mailpiece is presented inappropriately, it is considered that the mailpiece is sufficiently robust for it to be unstacked.

Therefore, the steps 34 and 35 are repeated as many times as necessary for the open and heterogeneous mailpieces until appropriate presentation is obtained for the current mailpiece to be unstacked within the time window T, but it is preferable, beyond a certain correction time without appropriate presentation being obtained, for an alarm to be triggered to give warning that manual action needs to be taken.

It should be understood that the invention is not limited merely to the embodiment of the unstacker device that is described above. In particular, without going beyond the ambit of the invention, it is possible to change the configuration of the sensors, by modifying the numbers and the positions of the sensors, and by applying different corrections in response to the signals delivered by the sensors.

Alternatively, provision can be made for the mode to be selected via a software man-machine interface connected to the unstacker, e.g. by means of an Ethernet connection. The operator can then act by dynamically selecting one of the three available modes or by activating the automatic mode change.

The invention claimed is:

1. A mailpiece unstacker device comprising an unstacker head, and a motor-driven feed magazine for moving mailpieces in a stack and on edge in a certain direction towards said unstacker head, wherein said unstacker head is suitable for separating a first mailpiece from the stack and for driving said first mailpiece in a direction that is transverse to said direction in which the stack of mailpieces move, and wherein said mailpiece unstacker device further comprises a first material sensor suitable for delivering a first signal indicating that a current mailpiece of the stack has a cover made of a plastics material;

a second material sensor suitable for delivering a second signal indicating that the current mailpiece includes a metal material; and a control unit for causing said feed magazine and said unstacker head to operate in a plurality of operating modes specific to the presence or to the absence of a plastics material and a metal material in the mailpieces to be unstacked, said control unit being arranged to choose an operating mode from among said plurality of operating modes as a function of the first and second signals.

2. An unstacker device according to claim 1, wherein said unstacker device further comprises:

a blower member disposed so as to blow a jet of air onto said mailpieces facing said unstacker head, a motor-drive, a main feed magazine comprising a belt conveyor that is motor driven, a perforated belt that is motor-driven by said motor-drive at variable speed controlled by said control unit, a paddle disposed facing said unstacker head and motor-driven so as to push the back of the stack towards said unstacker head, suction nozzles that are motor-driven, a drop forming channel constituting a secondary feed magazine between said belt conveyor and said unstacker head, and a secondary conveyer in the drop forming channel that is motor driven;

said control unit is arranged to choose an operating mode from among said plurality of operating modes comprising:

a) a first operating mode in which the control unit forces the unstacker device to operate so that a certain number of mailpieces facing the unstacker head are presented in an inclined position wherein the certain number of mailpieces are inclined backwards by about 15° relative to the unstacker head;

b) a second operating mode in which the control unit forces the unstacker device, to operate so that a certain number of mailpieces facing the unstacker head are presented in an upright position substantially parallel to the unstacker head; and c) a third operating mode in which the control unit forces the unstacker device to operate so that a certain number of mailpieces facing the unstacker head are presented in an intermediate position that is situated between the inclined position of the first operating mode and the upright position of the second operating mode.

3. An unstacker device according to claim 2, wherein the control unit has at least three sets of control parameters for causing the blower member to operate in one of the first, second, or third operating modes.

4. An unstacker device according to claim 3, wherein the blower member comprises: a first blower element disposed between the feed magazine and the unstacker head in such a manner as to blow a stream of air that is substantially vertical and that is directed upwards; a second blower element disposed downstream from said unstacker head relative to said transverse direction in such a manner as to blow a stream of air that is substantially vertical and that is directed upwards; and a third blower element disposed downstream from the unstacker head relative to said transverse direction in such a manner as to blow a stream of air that is substantially horizontal and that is directed in the opposite direction to the transverse direction.

5. An unstacker device according to claim 2, wherein the control unit has at least three sets of speed profile for causing the motor-drive means of the unstacker head to operate in one of said first, second, or third operating modes.

6. An unstacker device according to claim 1, wherein said first material sensor includes a gloss sensor.

7. An unstacker device according to claim 1, wherein said second material sensor includes an inductive sensor.

8. A machine for sorting large-format mailpieces referred to as "flats", said machine comprising an unstacker device according to claim 1.

* * * * *